US005516440A

United States Patent [19]

Dasai et al.

[11] Patent Number: 5,516,440

[45] Date of Patent: May 14, 1996

[54] LUBRICATING OIL COMPOSITION

[75] Inventors: Masashi Dasai; Akio Imahasi; Katsumi Katsuta, all of Ichihara, Japan

[73] Assignee: Idemitsu Kosan Co., Ltd., Tokyo, Japan

[21] Appl. No.: 238,059

[22] Filed: May 4, 1994

[30] Foreign Application Priority Data

Jun. 24, 1993 [JP] Japan ..... 5-153096

[51] Int. Cl.[6] ..... C10M 141/10

[52] U.S. Cl. ..... 252/32; 252/32.5; 252/42.7; 252/46.4; 252/46.6; 252/47.5

[58] Field of Search ..... 252/51.5 A, 32, 252/32.5, 42.7, 47.5, 46.4, 46.6

[56] References Cited

U.S. PATENT DOCUMENTS

| | | | |
|---|---|---|---|
| 2,892,784 | 6/1959 | Harle et al. . | |
| 3,624,019 | 11/1971 | Anderson | 252/49.5 |
| 3,702,824 | 11/1972 | Schlicht . | |
| 3,732,167 | 5/1973 | Foucher et al. . | |
| 3,821,236 | 6/1974 | Ripple | 252/47 |
| 3,909,420 | 9/1975 | Turnquest et al. | 252/47 |
| 4,123,368 | 10/1978 | Leister | 252/25 |
| 4,132,656 | 1/1979 | De Vries | 252/25 |
| 4,163,729 | 8/1979 | Adams | 252/25 |
| 4,308,182 | 12/1981 | Eckard | 252/25 |
| 4,800,034 | 1/1989 | Akao | 252/49.5 |

FOREIGN PATENT DOCUMENTS 1412483 11/1975 United Kingdom .

*Primary Examiner*—Margaret Medley

*Attorney, Agent, or Firm*—Antonelli, Terry, Stout & Kraus

[57] ABSTRACT

A lubricating oil composition is herein disclosed which comprises (a) a base oil comprising a mineral oil, a synthetic oil or both the oils, (b) a copolymer having repeating units of the formulae (I) and (II)

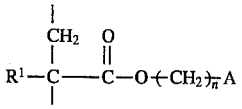

(I)

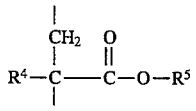

(II)

(c) an amine-based antioxidant, and if necessary, (d) a thiadiazole compound. The repeating unit of the formula (I) is derived from a monomer such as dimethylamino methacrylate. The repeating unit of the formula (II) is derived from a monomer such as a methacrylate of a long-chain alcohol. $R^1$ and A may be the same or different every repeating unit. This lubricating oil composition is minimized in change with the lapse of time in frictional characteristics (shift shock in an automatic transmission or the like) and is excellent in oxidation stability.

15 Claims, No Drawings

LUBRICATING OIL COMPOSITION

BACKGROUND OF THE INVENTION

1. Field of the Invention

The present invention relates to a lubricating oil composition. More particularly, it relates to a lubricating oil composition which is excellent in frictional characteristics and stability against oxidation, inhibits its change with the lapse of time, and is effectively utilizable as a lubricating oil for various kinds of equipment such as an automatic transmission, a continuously variable transmission, a gear of a tractor, a wet brake, a wet clutch and a power steering.

2. Description of Related Art

A lubricating oil which can be used to lubricate an automatic transmission, a continuously variable transmission, a gear of a tractor, a wet brake, a wet clutch, a power steering or the like is required to have good properties of frictional characteristics, oxidation stability, corrosion resistance, rust resistance and the like. Especially important requirements are that a ratio of a coefficient of static friction to a coefficient of kinematic friction by which the frictional characteristics are indicated is small and that a change in this ratio with the lapse of time is small.

Heretofore, as such a lubricating oil, there is known a lubricating oil having a high coefficient of static friction and good transmission torque. This kind of lubricating oil, however, is disadvantageous in that the frictional characteristics are not sufficiently satisfactory and a shift shock is large.

In recent years, with the miniaturization of cars and the abrupt increase in FF cars (front engine front wheel driven cars), the tendency of miniaturizing the automatic transmission and the like more and more increases. Such a miniaturization of the automatic transmission inconveniently makes a driver feel the shift shock more sensitively. Thus, in order to relieve the shift shock and to thereby make a car more comfortable to drive, it has been a technical subject to improve the frictional characteristics especially at an initial stage.

For the purpose of improving the frictional characteristics at the initial stage, there have been suggested a lubricating oil containing a friction modifier (Japanese Patent Application Laid-open Nos. 173097/1985 and 180000/1988) and a lubricating oil in which a base oil having a specific composition is used (Japanese Patent Application Laid-open No. 254196/1988). In these lubricating oils, however, the change with the lapse time in the frictional characteristics is large, and so they are not considered to have a sufficient performance.

SUMMARY OF THE INVENTION

The present invention intends to overcome the above-mentioned problems of conventional techniques, and an object of the present invention is to provide a lubricating oil composition which is excellent in frictional characteristics at an initial stage and oxidation stability and which can maintain the frictional characteristics for a long period of time.

Under such circumstances, the present inventors have conducted research. As a result, it has been found that the change with the lapse of time in the frictional characteristics can be effectively inhibited by blending a lubricating oil composition with a specific copolymer belonging to a dispersion type polymer and an amine-based antioxidant. The present invention has been completed on the basis of such a knowledge.

That is, the present invention is directed to a lubricating oil composition which comprises (a) a base oil comprising at least one selected from the group consisting of mineral oils and synthetic oils, (b) a copolymer having a repeating unit (I) represented by the formula (I)

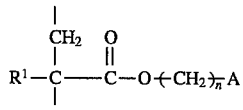

(I)

wherein $R^1$ is hydrogen or an alkyl group having 1 to 6 carbon atoms; A is a group of the following formula (I-1), (I-2), (I-3), (I-4), (I-5) or (I-6); n is an integer of 1 to 8;

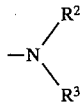

(I-1)

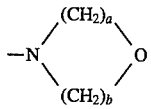

(I-2)

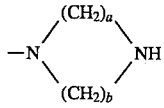

(I-3)

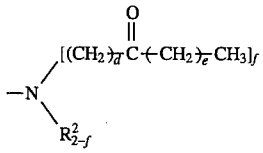

(I-4)

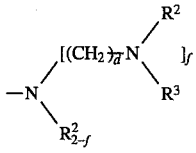

(I-5)

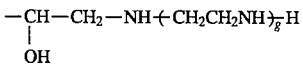

(I-6)

wherein each of $R^2$ and $R^3$ is independently hydrogen or an alkyl group having 1 to 20 carbon atoms; each of a and b is independently an integer of 1 to 3; each of d and e is independently an integer of 1 to 6; f is an integer of 1 or 2; g is an integer of 0 to 6; and $R^1$ and A may be the same or different every repeating unit, and a repeating unit (II) represented by the formula (II)

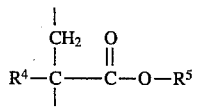

(II)

wherein $R^4$ is hydrogen or an alkyl group having 1 to 6 carbon atoms; $R^5$ is an alkyl group having 1 to 24 carbon atoms, and $R^4$ and $R^5$ may be the same or different every repeating unit, (c) an amine-based antioxidant and (d) a thiadiazole compound.

DESCRIPTION OF PREFERRED EMBODIMENTS

As a base oil which is a component (a) of the present invention, there can be used a mineral oil, a synthetic oil or a mixture thereof. No particular restriction is put on the kind of mineral oil or synthetic oil, but in general, the mineral oil or the synthetic oil having a kinematic viscosity at 100° C. of 1.5 to 30 cSt is used.

Examples of the mineral oil include paraffinic mineral oils, intermediate mineral oils and naphthenic mineral oils. Furthermore, examples of the synthetic oil include alicyclic hydrocarbons, fused alicyclic hydrocarbons, bridgehead alicyclic hydrocarbons, polybutene, polyolefins (inclusive of poly-α-olefins), various kinds of esters (polyol esters, dibasic acid esters, phosphoric acid esters and the like), alkylbenzenes and alkylnaphthalenes.

The base oil of the present invention can be beforehand blended with additives other than the components (b) to (d).

A copolymer which is a component (b) of the present invention belongs to a dispersion type polymer from the viewpoint of a chemical structure, and it is used as a viscosity index improver. It is well known that a viscosity index improver is blended with a lubricating oil composition, and as this viscosity index improver, there are also known dispersion type polymers (dimethylaminopropylmethacrylamide base, vinylpyrrolidone base and the like) in addition to the above-mentioned component (b) and non-dispersion type polymers. However, if the viscosity index improver other than the copolymer specified as the component (b) is used, the change with the lapse of time in the frictional characteristics of the lubricating oil composition cannot be effectively inhibited.

The copolymer which is the component (b) is a random copolymer, a block copolymer, a graft copolymer or a mixture of these copolymers having a repeating unit (I) represented by the formula (I)

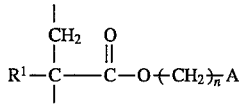

(I)

wherein $R^1$ is hydrogen or an alkyl group having 1 to 6 carbon atoms; A is a group of the following formula (I-1), (I-2), (I-3), (I-4), (I-5) or (I-6); n is an integer of 1 to 8;

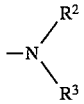

(I-1)

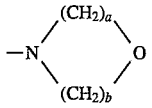

(I-2)

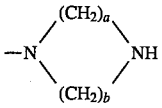

(I-3)

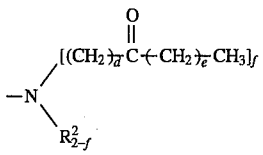

(I-4)

-continued

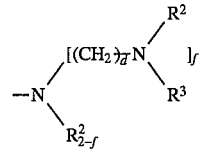

(I-5)

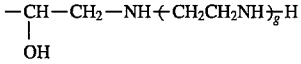

(I-6)

wherein each of $R^2$ and $R^3$ is independently hydrogen or an alkyl group having 1 to 20 carbon atoms; each of a and b is independently an integer of 1 to 3; each of d and e is independently an integer of 1 to 6; f is an integer of 1 or 2; g is an integer of 0 to 6; and $R^1$ and A may be the same or different every repeating unit, and a repeating unit (II) represented by the formula (II)

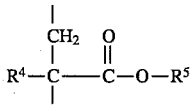

(II)

wherein $R^4$ is hydrogen or an alkyl group having 1 to 6 carbon atoms; $R^5$ is an alkyl group having 1 to 24 carbon atoms, and $R^4$ and $R^5$ may be the same or different every repeating unit.

Above all, preferable is a copolymer in which A in the repeating unit (I) is the group of (I-1).

No particular restriction is put on the contents of the respective repeating units in this copolymer, but the content of the repeating unit (I) is usually in the range of 0.5 to 20 parts by weight, preferably 1 to 10 parts by weight with respect to 100 parts by weight of the repeating unit (II).

If the content of the repeating unit (I) is less than 0.5 part by weight, the change with the lapse of time in the frictional characteristics cannot be sufficiently inhibited sometimes, and if it is more than 20 parts by weight, the additional inhibition effect on the change with the lapse of time cannot be expected any more.

No particular restriction is put on the molecular weight of the copolymer, but it is usually in the range of 5,000 to 500,000, preferably 10,000 to 150,000 in terms of number-average molecular weight.

The copolymer can be obtained by copolymerizing a raw material monomer represented by the formula (III)

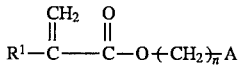

(III)

wherein $R^1$, A and n are as defined above, and a raw material monomer represented by the formula (IV)

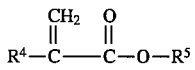

(IV)

wherein $R^4$ and $R^5$ are as defined above, in a known manner. Here, the raw material monomer of the formula (III) can provide the repeating unit (I), and the raw material monomer of the formula (IV) can provide the repeating unit (II).

Examples of the raw material monomer represented by the formula (III) include dimethylaminoethyl acrylate, diethylaminoethyl acrylate, dimethylaminopropyl acrylate, dibutylaminopropyl acrylate, dioctylaminoethyl acrylate, dilaurylaminopropyl acrylate; methacrylates corresponding to these acrylates; and mixtures of these compounds.

Examples of the raw material monomer represented by the formula (IV) include esters of acrylic acid or methacrylic acid and alcohols such as methyl alcohol, ethyl alcohol, propyl alcohol, butyl alcohol, pentyl alcohol, hexyl alcohol, octyl alcohol, 2-ethylhexyl alcohol, decyl alcohol, dodecyl alcohol, tridecyl alcohol, tetradecyl alcohol, hexadecyl alcohol, octadecyl alcohol, cyclohexyl alcohol and benzyl alcohol; and mixtures of these esters.

The copolymer which is the component (b) may contain a repeating unit other than the above-mentioned repeating units (I) and (II), so long as it does not impair the object of the present invention.

For example, in manufacturing the copolymer which is the component (b), another vinyl monomer containing nitrogen or the like which can be used with the monomer of the formula (III) (N-vinylpyrrolidone, N-vinylthiopyrrolidone, a dialkylaminoalkylmethacrylamide, morpholinoethyl methacrylate, N-vinylimidazole or the like) can be copolymerized or graft-polymerized. Alternatively, a non-vinyl compound containing nitrogen or the like (phenothiazine, imidazole, thiazole, benzothiazole, triazole, thiazolidine, pyrimidine, pyridine, piperidine, pyrrolidinone, oxazole, thiomorpholine or the like) can be grafted.

In the case that the component (b) contains the repeating unit derived from any of these monomers, its content should be usually 100 parts by weight or less, preferably 60 parts by weight or less with respect to 100 parts by weight of the repeating unit (I).

On the other hand, examples of the other monomer which can be used with the monomer of the formula (IV) include vinyl aromatic compounds (styrene, vinyltoluene and the like). In manufacturing the copolymer which is the component (b), any of these monomers can be copolymerized or graft-polymerized. In the case that the component (b) contains the repeating unit derived from any of these monomers, its content should be usually 100 parts by weight or less, preferably 50 parts by weight or less with respect to 100 parts by weight of the repeating unit (II).

The amount of the copolymer which is the component (b) is usually in the range of 1 to 20% by weight, preferably 2 to 10% by weight based on the total weight of the lubricating oil composition.

In the lubricating oil composition of the present invention not only the component (b) but also an amine-based antioxidant which is a component (c) is used as an essential component. It is well known that an antioxidant is blended with the lubricating oil composition, and various kinds of antioxidants are known in addition to the amine-based antioxidant. However, in order to effectively inhibit the change with the lapse of time in the frictional characteristics of the lubricating oil composition, it is necessary to use the amine-based antioxidant.

No particular restriction is put on the kind of amine-based antioxidant which can be used as the component (c), and various kinds of amine-based antioxidants can be used. Examples of such an amine-based antioxidant include diphenylamine derivatives represented by the formula (V)

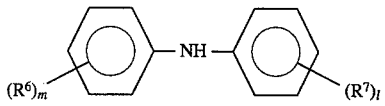

(V)

wherein each of $R^6$ and $R^7$ is independently an alkyl group having 1 to 20 carbon atoms or an alkenyl group having 1 to 20 carbon atoms; and each of m and l is independently an integer of 0 to 4; and when m and/or l is 2 or more, $R^6$s and/or $R^7$s may be the same or different. Examples of the compounds represented by the formula (V) include diphenylamine, dioctyldiphenylamine, dinonyldiphneylamine, dioleyldiphenylamine and p-butyl-p'-octyldiphenylamine.

In addition, phenyl-α-naphthylamine derivatives represented by the following formula (VI) can also be employed as the amine-based antioxidant:

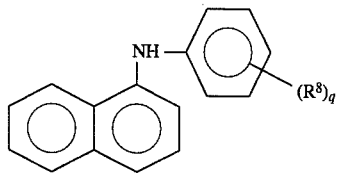

(VI)

wherein $R^8$ is an alkyl group having 1 to 20 carbon atoms or an alkenyl group having 1 to 20 carbon atoms; q is an integer of 0 to 5; and when q is 2 or more, $R^8$s may be the same or different.

Examples of the compound represented by the formula (VI) include phenyl-α-naphthylamine, octylphenyl-α-naphthylamine and oleylphenyl-α-naphthylamine.

The amount of the amine-based antioxidant which is the component (c) is usually in the range of 0.05 to 5.0% by weight, preferably 0.1 to 2.0% by weight based on the total weight of the lubricating oil composition. If the amount of the amine-based antioxidant is less than 0.05% by weight, its antioxidant effect is not sufficient and the effect of inhibiting the change with the lapse of time in the frictional characteristics which is the primary object of the present invention cannot be sufficiently obtained sometimes. On the other hand, if the amount of the amine-based antioxidant is more than 5.0% by weight, the additional inhibition effect on the change with the lapse of time cannot be expected any more.

The amine-based antioxidants may be used singly or in combination of two or more thereof.

A thiadiazole compound which is a component (d) of the present invention is used as a metal deactivator. In the case that the thiadiazole compound is blended with the lubricating oil composition of the present invention, the change with the lapse of time in the frictional characteristics of the lubricating oil composition can be further effectively inhibited. No particular restriction is put on the thiadiazole compound which can be used as the component (d), and various kinds of thiadiazole compounds can be used. Examples of such a thiadiazole compound include 1,3,4-thiadiazole compounds, 1,2,4-thiadiazole compounds and mixtures of these thiadiazole compounds represented by the formula (VII) or (VIII)

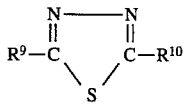

(VII)

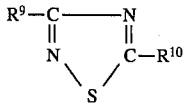

(VIII)

wherein each of $R^9$ and $R^{10}$ is independently hydrogen, a hydrocarbon group having 1 to 30 carbon atoms, or a group represented by the formula (IX), (X) or (XI)

$$-S-R^{11} \quad \text{(IX)}$$

$$-S-S-R^{12} \quad \text{(X)}$$

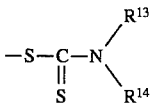

(XI)

wherein each of $R^{11}$, $R^{12}$, $R^{13}$ and $R^{14}$ is independently hydrogen or a hydrocarbon group having 1 to 30 carbon atoms.

Typical examples of the compounds having the formulae (VII) and (VIII) include 2,5-dimethylcapto-1,3,4-thiadiazole, 2,5-bis(hexyldithio)-1,3,4-thiadiazole, 2,5-bis(octyldithio)- 1,3,4-thiadiazole, 2,5-bis(N,N-diethyldithiocarbamyl)- 1,3,4-thiadiazole, 3,5-dimercapto-1,2,4-thiadiazole, 3,5-bis(hexyldithio)-1,2,4-thiadiazole, 3,5-bis(octyldithio)-1,2,4-thiadiazole and 3,5-bis(N,N-diethyldithiocarbamyl)-1,2,4-thiadiazole.

The amount of the thiadiazole compound which is the component (d) is usually in the range of 0.01 to 3.0% by weight, preferably 0.02 to 1.0% by weight based on the total weight of the lubricating oil composition. If the amount of the thiadiazole compound is less than 0.01% by weight, the inhibition effect on the change with the lapse of time in the frictional characteristics cannot be sufficiently obtained. On the other hand, if the amount is more than 3.0% by weight, sludge is likely to occur.

These thiadiazole compounds may be used singly or in combination of two or more thereof.

The lubricating oil composition of the present invention can be obtained by blending the base oil as the component (a) with the specific copolymer as the component (b), the amine-based antioxidant as the component (c), and if necessary, the thiadiazole compound as the component (d).

The lubricating oil composition of the present invention can be blended with a friction modifier, if necessary. As described above., the friction modifier is blended for the purpose of improving the frictional characteristics.

As the friction modifier, there can be usually employed various substances such as an oiliness agent, a friction inhibitor and an extreme pressure agent. Preferable examples of the friction modifier include phosphoric acid esters, phosphorous acid esters, amine salts of the phosphoric acid esters, amine salts of the phosphorous acid esters, sorbitan fatty acid esters, pentaerythritol fatty acid esters, glycerin fatty acid esters, trimethylolpropane fatty acid esters, glycol fatty acid esters, carboxylic acids, carboxylic acid amides, carboxylic acid esters, metal salts of the carboxylic acids, oils, fats, higher alcohols and sulfur compounds. They can be used singly or in combination.

Preferable examples of the above-mentioned phosphoric acid esters and phosphorous acid esters are represented by the formulae (XII) to (XIV)

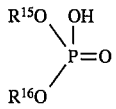
(XII)

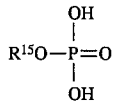
(XIII)

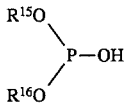
(XIV)

wherein each of $R^{15}$ and $R^{16}$ is an alkyl group, an aryl group or an alkyl-substituted aryl group each having 4 to 30 carbon atoms, and $R^{15}$ and $R^{16}$ may be the same or different.

Typical examples of the phosphoric acid esters and the phosphorous acid esters include butyl acid phosphate, 2-ethylhexyl acid phosphate, lauryl acid phosphate, oleyl acid phosphate, stearyl acid phosphate, dibutylhydrogen phosphite, dilaurylhydrogen phosphite, dioleylhydrogen phosphite, distearylhydrogen phosphite and diphenylhydrogen phosphite.

Examples of the amine salts of the phosphoric acid esters and the amine salts of the phosphorous acid esters include oleylamine salts, coconut amine salts and beef tallow amine salts of the phosphoric acid esters and the phosphorous acid esters.

Next, typical examples of the sorbitan fatty acid esters include sorbitan monolaurate, sorbitan monocleate, sorbitan monostearate, sorbitan sesquioleate, sorbitan dioleate and mixtures thereof.

Typical examples of the pentaerythritol fatty acid esters include monoesters, diesters and triesters of pentaerythritol or dipentaerythritol and fatty acids such as capric acid, lauric acid, myristic acid, palmitic acid, stearic acid, oleic acid, linolic acid and behenic acid, and mixtures thereof.

Typical examples of the glycerin fatty acid esters include monoglyceride oleate, monoglyceride stearate, diglyceride oleate and mixtures thereof.

Typical examples of the trimethylolpropane fatty acid esters include monoesters and diesters of trimethylolpropane and fatty acids such as capric acid, lauric acid, myristic acid, palmitic acid, stearic acid, oleic acid, linolic acid and behenic acid, and mixtures thereof.

Typical examples of the glycol fatty acid esters include monoesters of propylene glycol, trimethylene glycol, 1,4-butanediol and neopentyl glycol and fatty acids such as capric acid, lauric acid, myristic acid, palmitic acid, stearic acid, oleic acid, linolic acid and behenic acid, and mixtures thereof.

Examples of the carboxylic acids include aliphatic carboxylic acids, divalent carboxylic acids (dibasic acids) and aromatic carboxylic acids. The aliphatic carboxylic acids have 8 to 30 carbon atoms and may be saturated or unsaturated. Typical examples of the aliphatic carboxylic acids include pelargonic acid, lauric acid, tridecanoic acid, myristic acid, palmitic acid, stearic acid, eicosanic acid, behenic acid, triacontanoic acid, undecylenic acid, oleic acid, linolic acid, linolenic acid, erucic acid, and fatty acids of oils and fats (coconut oil fatty acid, palm kernel oil and the like). Typical examples of the divalent carboxylic acids include octadecylsuccinic acid, octadecenylsuccinic acid, polybutenylsuccinic acid, adipic acid, azelaic acid, sebacic acid and dodecanoic diacid. Examples of the aromatic carboxylic acid include salicylic acid and the like.

As the carboxylic acid amides, various amides are usable, and examples of the carboxylic acid amides include reaction products of the above-mentioned carboxylic acids and amine compounds (diethylenetriamine, triethylenetetramine, tetraethylenepentamine, hexaethylenepentamine, heptaethyleneoctamine, tetrapropylenepentamine and hexabutyleneheptamine, and alkanolamines such as monoethanolamine and diethanolamine).

Examples of the carboxylic acid esters include aliphatic carboxylic acid esters and divalent carboxylic acid esters (dibasic acid esters). As these aliphatic carboxylic acid esters, there are usually used alkyl esters of the above-mentioned aliphatic carboxylic acids (methyl ester, ethyl ester, propyl ester, butyl ester, octyl ester, lauryl ester and oleyl ester). Examples of the divalent carboxylic acid esters include monoalkyl esters of the above-mentioned divalent carboxylic acids and glycol esters of propylene glycol and the like.

Examples of the above-mentioned metal salts of the carboxylic acids include zinc laurate, zinc oleate, zinc stearate, zinc salt of coconut oil fatty acid, aluminum stearate and magnesium salicylate.

Examples of the oils and fats include animal oils and fats such as lard, beef tallow and fish oils, and vegetable oils and fats such as soybean oil, rapeseed oil, rice bran oil, palm oil, palm kernel oil and coconut oil.

Examples of the higher alcohols include octyl alcohol, lauryl alcohol, myristyl alcohol, oleyl alcohol and stearyl alcohol.

Furthermore, examples of the sulfur compounds include sulfide oils and fats, and a reaction product of phosphorus sulfide and pinene.

In the present invention, any of these compounds can be used as the friction modifier, but above all, particularly suitable are the phosphoric acid esters, the phosphorous acid esters, their amine salts, the carboxylic acid amides, the glycerin fatty acid esters, the sorbitan fatty acid esters, the metal salts of the carboxylic acids, the divalent carboxylic acid esters (the dibasic acid esters) and mixtures of two or more thereof.

The lubricating oil composition of the present invention can be blended with an antioxidant other than the amine-based antioxidant which is the component (c), a detergent-dispersant and the like.

Examples of the antioxidant other than the amine-based antioxidant include phenolic antioxidants (2,6-di-t-butyl-4-methylphenol and the like), zinc di-2-ethylhexyldithiophosphate, zinc diamyldithiocarbamate and pinene pentasulfide. In the case that any of these antioxidants is blended, its amount is usually 3% or less by weight based on the total weight of the lubricating oil composition.

As the detergent-dispersant, there can be used an ash-free detergent-dispersant, a metallic detergent-dispersant, an ash-free detergent-dispersant containing boron, or the like. Typical preferable examples of the detergent-dispersant include alkenylsuccinic acid imides, sulfonates and phenates such as polybutenylsuccinic acid imide, calcium sulfonate, barium sulfonate, calcium phenate, barium phenate and calcium salicylate. The amount of the detergent-dispersant to be blended is usually in the range of 0.1 to 10% by weight, preferably from 0.5 to 5% by weight based on the total weight of the lubricating oil composition.

Moreover, the lubricating oil composition of the present invention can be further blended with a pour point depressant, a corrosion inhibitor, a rubber swelling agent, a defoaming agent, a colorant and the like.

As described above, in the lubricating oil composition of the present invention, the change with the lapse of time in frictional characteristics can be inhibited, so that the frictional characteristics at an initial stage can be maintained for a long period of time and the increase in shift shock can be prevented. In addition, the lubricating oil composition is excellent in oxidation stability, and hence durability is also excellent.

Therefore, the lubricating oil composition of the present invention can be sufficiently applied to the miniaturization of a transmission or the like, and it is exceptionally effective as a lubricating oil for an automatic transmission or a continuously variable transmission, and as a lubricating oil for a wet clutch or a wet brake of an agricultural tractor or the like.

Moreover, the lubricating oil composition of the present invention which has such characteristics is also effective as a lubricating oil for a shock absorber, a power steering, a hydraulic suspension or any of various construction machines, and as a lubricating oil for plural purposes of use thereof.

Next, the present invention will be described in more detail with reference to examples and comparative examples, but the scope of the present invention should not be limited to any of these examples.

EXAMPLES 1 TO 5 AND COMPARATIVE EXAMPLES 1 TO 8

(1) Preparation of Lubricating Oil Composition

A base oil was prepared comprising 95.0% by weight of a mineral oil having a kinematic viscosity at 100° C. of 5.0 cSt, 1.0% by weight of an amine salt of oleylhydrogen phosphite (a friction modifier) and 4.0% by weight of polybutenylsuccinic acid imide (a detergent-dispersant). Afterward, compounds shown in Table 1 were added to the base oil in predetermined ratios to obtain lubricating oil compositions.

(2) Performance Tests

For the lubricating oil compositions prepared in the above-mentioned paragraph (1) just after the preparation and after the step of forced degradation, the following performance tests were made. The results are shown in Table 1. The forced degradation was carried out at 150° C. for 48 hours in accordance with Oxidation Stability Test of Lubricating Oil for Internal Combustion Engine (JIS K 2514).

SAE (Society of Automotive Engineers) No. 2 Friction Test

Frictional characteristics were evaluated under the following conditions by the use of an SAE No. 2 tester manufactured by Greening Association Inc. (U.S.A.).

Test Conditions

Discs: Two paper discs for an automatic transmission made in Japan

Plates: Three steel plates for the automatic transmission made in Japan

Revolving Speed of motor: 3,600 rpm

Piston Pressure: 38 psi

Oil temperature: 120° C.

A coefficient of kinematic friction ($\mu_{1200}$) at a revolving speed of 1,200 rpm under the above-mentioned conditions and a coefficient of static friction ($\mu_0$) at the time of stop were measured, and $\mu_0/\mu_{1200}$ ($\mu_0/\mu_K$) was then calculated.

Oxidation Stability Test

An oxidation stability test was made at 170° C. for 96 hours in accordance with Oxidation Stability Test of Lubricating Oil for Internal Combustion Engine (JIS K 2514) to measure a viscosity ratio at 40° C., an increase in a total acid value and an insoluble residue (% by weight) by an n-pentan B method.

TABLE 1

| | Example | | | | |
|---|---|---|---|---|---|
| | 1 | 2 | 3 | 4 | 5 |
| Components of the Composition (wt %) | | | | | |
| Base Oil*1 | 94.2 | 94.2 | 93.9 | 93.7 | 94.2 |
| Viscosity Index Improver | | | | | |
| Dimethylaminopropyl Methacrylate Base*2 | 5 | 5 | 5 | 5 | 3 |
| Dimethylaminopropyl Methacrylamide Base*3 | — | — | — | — | — |
| Vinylpyrrolidone Base*4 | — | — | — | — | — |
| Non-dispersion Type Polymethacryalte*5 | — | — | — | — | 2 |
| Antioxidant | | | | | |
| Dioctyldiphenylamine*6 | 0.5 | — | 0.5 | 0.5 | 0.5 |
| Phenyl-α-naphthylamine*7 | — | 0.5 | — | — | — |

TABLE 1-continued

| | | | | | |
|---|---|---|---|---|---|
| 2,6-di-t-butyl-4-methylphenol*8 | — | — | — | 0.5 | — |
| 1,3,4-thiadiazole Polysulfide*9 | 0.3 | 0.3 | 0.6 | 0.3 | 0.3 |
| Test Results | | | | | |
| SAE No. 2 Test ($\mu_0/\mu_K$) | | | | | |
| Fresh Oil | 1.02 | 1.02 | 1.01 | 1.03 | 1.02 |
| Degradated Oil | 1.04 | 1.03 | 1.02 | 1.06 | 1.04 |
| Oxidation Stability Test | | | | | |
| Viscosity Ratio | 1.06 | 1.04 | 1.02 | 1.05 | 1.07 |
| Increase in Total Acid Value | 0.94 | 0.82 | 0.73 | 0.77 | 0.75 |
| Insoluble Residue | 0.02 | 0.02 | 0.03 | 0.02 | 0.08 |

| | Comparative Example | | | | |
|---|---|---|---|---|---|
| | 1 | 2 | 3 | 4 | 5 |
| Components of the Composition (wt %) | | | | | |
| Base Oil*1 | 94.7 | 94.2 | 94.4 | 94.2 | 94.2 |
| Viscosity Index Improver | | | | | |
| Dimethylaminopropyl Methacrylate Base*2 | 5 | 5 | 5 | — | — |
| Dimethylaminopropyl Methacrylamide Base*3 | — | — | — | — | — |
| Vinylpyrrolidone Base*4 | — | — | — | 5 | — |
| Non-dispersion Type Polymethacryalte*5 | — | — | — | — | 5 |
| Antioxidant | | | | | |
| Dioctyldiphenylamine*6 | — | — | — | 0.5 | 0.5 |
| Phenyl-α-naphthylamine*7 | — | — | — | — | — |
| 2,6-di-t-butyl-4-methylphenol*8 | — | 0.5 | — | — | — |
| 1,3,4-thiadiazole Polysulfide*9 | 0.3 | 0.3 | 0.6 | 0.3 | 0.3 |
| Test Results | | | | | |
| SAE No. 2 Test ($\mu_0/\mu_K$) | | | | | |
| Fresh Oil | 1.02 | 1.03 | 1.02 | 1.03 | 1.02 |
| Degradated Oil | 1.25 | 1.18 | 1.20 | 1.12 | 1.14 |
| Oxidation Stability Test | | | | | |
| Viscosity Ratio | 1.36 | 1.19 | 1.25 | 1.10 | 1.12 |
| Increase in Total Acid Value | 5.11 | 2.02 | 4.12 | 1.23 | 1.41 |
| Insoluble Residue | 2.50 | 0.79 | 2.00 | 1.05 | 1.24 |

| | Comparative Example | | |
|---|---|---|---|
| | 6 | 7 | 8 |
| Components of the Composition (wt %) | | | |
| Base Oil*1 | 94.7 | 94.2 | 94.2 |
| Viscosity Index Improver | | | |
| Dimethylaminopropyl Methacrylate Base*2 | — | — | — |
| Dimethylaminopropyl Methacrylamide Base*3 | 5 | 5 | 5 |
| Vinylpyrrolidone Base*4 | — | — | — |
| Non-dispersion Type Polymethacryalte*5 | — | — | — |
| Antioxidant | | | |
| Dioctyldiphenylamine*6 | — | — | 0.5 |
| Phenyl-α-naphthylamine*7 | — | — | — |
| 2,6-di-t-butyl-4-methylphenol*8 | — | 0.5 | — |
| 1,3,4-thiadiazole Polysulfide*9 | 0.3 | 0.3 | 0.3 |
| Test Results | | | |
| SAE No. 2 Test ($\mu_0/\mu_K$) | | | |
| Fresh Oil | 1.02 | 1.03 | 1.01 |
| Degradated Oil | 1.27 | 1.20 | 1.12 |
| Oxidation Stability Test | | | |
| Viscosity Ratio | 1.40 | 1.22 | 1.10 |
| Increase in Total Acid Value | 5.72 | 3.13 | 1.35 |
| Insoluble Residue | 3.00 | 1.01 | 1.07 |

*1Base oil: This consists of 95.0% by weight of the mineral oil having a kinematic viscosity at 100° C. of 5.0 cSt, 1.0% by weight of the amine salt of oleylhydrogen phosphite (the friction modifier) and 4.0% by weight of polybutenylsuccinic acid imide (the detergent-dispersant).

*2Dimethylaminopropyl methacrylate base: This is a copolymer of dimethylaminopropyl methacrylate which is a monomer having the formula (III) and a methacrylate of a long-chain alcohol having 12 to 18 carbon atoms which is a monomer of the formula (IV). This number-average molecular weight is 30,000. The content of a repeating unit derived from dimethylaminopropyl methacrylate is 5% by weight, and the content of a repeating unit derived from the methacrylate of the long-chain alcohol having 12 to 18 carbon atoms is 95% by weight. This is a dispersion type polymer which is a component (b) of the present invention.

*3Dimethylaminopropylmethacylamide base: This is a copolymer of dimethylaminopropylmethacrylamide and a methacrylate of a long-chain alcohol having 12 to 18 carbon atoms which is a monomer of the formula (IV). This number-average molecular weight is 30,000. The content of a repeating unit derived from dimethylaminopropylmethacrylamide is 5% by weight, and the content of a repeating unit derived from the methacrylate of the long-chain alcohol having 12 to 18 carbon atoms is 95% by weight. This is a dispersion type polymer other than the component (b) of the present invention.

*4Vinylpyrrolidone base: This is a copolymer of vinylpyrrolidone and a methacrylate of a long-chain alcohol having 12 to 18 carbon atoms which is a monomer of the fromula (IV). This number-average molecular weight is 30,000. The content of a repeating unit derived from vinylpyrrolidone is 3% by weight, and the content of a repesting unit derived from the methacrylate of the long-chain alcohol having 12 to 18 carbon atoms is 97% by weight. This is a dispersion type polymer other than the component (b) of the present invention.

*5Non-dispersion type polymethacrylate: This is a polymer consisting only of a methacrylate of a long-chain alcohol having 12 to 18 carbon atoms which is a monomer of the formula (IV). This number-average molecular weight is 30,000.

*6Dioctyldiphenylamine: This is a amine-based antioxidant which is a component (c) of the present invention.

*7Phenyl-α-naphthylamine: This is an amine-based antioxidant which is the component (c) of the present invention.

*8 2,6-di-t-butyl-4-methylphenol: This is an antioxidant other than the amine-based antioxidant, and it does not correspond to the component (c) of the present invention.

*9 1,3,4-thiadiazole polysulfide: This is a thiadiazole compound which can be used as a metal deactivator, and it corresponds to the component (d) of the present invention.

What is claimed is:

1. A lubricating oil composition for an automatic transmission or a continuously variable transmission which comprises (a) a base oil comprising at least one selected from the group consisting of mineral oils and synthetic oils, (b) a copolymer having a repeating unit (I) represented by the formula (I)

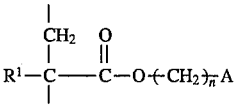

(I)

wherein $R^1$ is hydrogen or an alkyl group having 1 to 6 carbon atoms; A is a group of the following formula (I-1); n is an integer of 1 to 8;

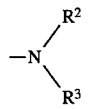

(I-1)

wherein each of $R^2$ and $R^3$ is independently hydrogen or an alkyl group having 1 to 20 carbon atoms; and $R^1$ and A may be the same or different every repeating unit, and a repeating unit (II) represented by the formula (II)

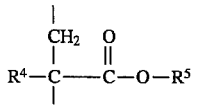

(II)

wherein $R^4$ is hydrogen or an alkyl group having 1 to 6 carbon atoms; $R^5$ is an alkyl group having 1 to 24 carbon atoms, and $R^4$ and $R^5$ may be the same or different every repeating unit, (c) an amine-based antioxidant, a (d) thiadiazole compound which is a 1,3,4-thiadiazole compound, a 1,2,4-thiadiazole compound or a mixture of these thiadiazole compounds represented by the formula (VII) and (VIII)

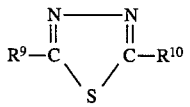

(VII)

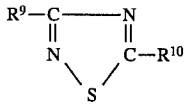

(VIII)

wherein each of $R^9$ and $R^{10}$ is independently hydrogen, a hydrocarbon group having 1 to 30 carbon atoms, or a group represented by the formula (IX), (X) or (XI)

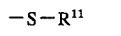

(IX)

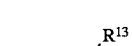

(X)

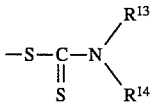

(XI)

wherein each of $R^{11}$, $R^{12}$, $R^{13}$ and $R^{14}$ is independently hydrogen or a hydrocarbon group having 1 to 30 carbon atoms, and (e) a phosphorous acid ester or an amine salt of a phosphorous acid ester.

2. The lubricating oil composition according to claim 1 wherein the content of said copolymer which is the component (b) is in the range of 1 to 20% by weight.

3. The lubricating oil composition according to claim 2 wherein said component (b) is obtained by copolymerizing a raw material monomer represented by the formula (III)

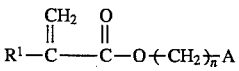

(III)

wherein $R^1$, A and n are as defined in claim 1, and a raw material monomer represented by the formula (IV)

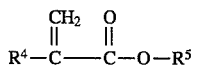

(IV)

wherein $R^4$ and $R^5$ are as defined in claim 1.

4. The lubricating oil composition according to claim 3 wherein said raw material monomer represented by the formula (III) is selected from the group consisting of dimethylaminoethyl acrylate, diethylaminoethyl acrylate, dimethylaminopropyl acrylate, dibutylaminopropyl acrylate, dioctylaminoethyl acrylate, dilaurylaminopropyl acrylate; methacrylates corresponding to these acrylates; and a mixture of at least two of the aforesaid compounds.

5. The lubricating oil composition according to claim 3 wherein said raw material monomer represented by the formula (IV) is selected from the group consisting of esters of acrylic acid or methacrylic acid and alcohols such as methyl alcohol, ethyl alcohol, propyl alcohol, butyl alcohol, pentyl alcohol, hexyl alcohol, octyl alcohol, 2-ethylhexyl alcohol, decyl alcohol, dodecyl alcohol, tridecyl alcohol, tetradecyl alcohol, hexadecyl alcohol, octadecyl alcohol, cyclohexyl alcohol and benzyl alcohol, and a mixture of at least two of the aforesaid esters.

6. The lubricating oil composition according to claim 1 wherein the content of said amine-based antioxidant which is the component (c) is in the range of 0.05 to 5% by weight.

7. The lubricating oil composition according to claim 6 wherein said component (c) is a diphenylamine derivative represented by the formula (V)

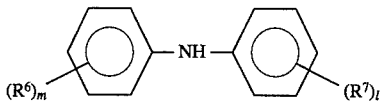

(V)

wherein each of $R^6$ and $R^7$ is independently an alkyl group having 1 to 20 carbon atoms or an alkenyl group having 1 to 20 carbon atoms; and each of m and l is independently an integer of 0 to 4; and when at least one of m and l is 2 or more, a plurality of at least one of $R^6$ and $R^7$ may be each the same or different.

8. The lubricating oil composition according to claim 7 wherein said diphenylamine derivative represented by the formula (V) is selected from the group consisting of diphenylamine, dioctyldiphenylamine, dinonyldiphneylamine, dioleyldiphenylamine and p-butyl-p'-octyldiphenylamine.

9. The lubricating oil composition according to claim 6 wherein said component (c) is a phenyl-α-naphthylamine derivative represented by the following formula (VI)

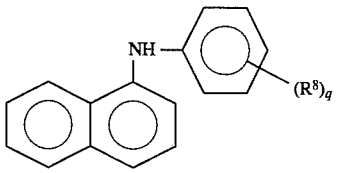

(VI)

wherein $R^8$ is an alkyl group having 1 to 20 carbon atoms or an alkenyl group having 1 to 20 carbon atoms; q is an integer of 0 to 5; and when q is 2 or more, $R^8$s may be the same or different.

10. The lubricating oil composition according to claim 9 wherein said phenyl-α-naphthylamine derivative represented by the formula (VI) is selected from the group consisting of phenyl-α-naphthylamine, octylphenyl-α-naphthylamine and oleylphenyl-α-naphthylamine.

11. The lubricating oil composition according to claim 1 wherein the content of said thiadiazole compound which is the component (d) is in the range of 0.01 to 3% by weight.

12. The lubricating oil composition according to claim 1 wherein said thiadiazole compound is selected from the group consisting of 2,5-dimethylcapto-1,3,4-thiadiazole; 2,5-bis(hexyldithio)-1,3,4-thiadiazole; 2,5-bis-(octyldithio)-1,3,4-thiadiazole; 2,5-bis(N,N-diethyldithiocarbamyl)- 1,3,4-thiadiazole; 3,5-dimercapto-1,2,4-thiadiazole; 3,5-bis(hexyldithio)-1,2,4-thiadiazole; 3,5-bis(octyldithio)- 1,2,4-thiadiazole and 3,5-bis(N,N-diethyldithiocarbamyl)- 1,2,4-thiadiazole.

13. The lubricating oil composition according to claim 1 which further comprises a friction modifier selected from the group consisting of phosphoric acid esters, amine salts of the phosphoric acid esters, sorbitan fatty acid esters, pentaerythritol fatty acid esters, glycerin fatty acid esters, trimethylolpropane fatty acid esters, glycol fatty acid esters, aliphatic carboxylic acids, aromatic carboxylic acids, carboxylic acid amides, carboxylic acid esters, metal salts of the carboxylic acids, oils, fats, higher alcohols and sulfur compounds.

14. The lubricating oil composition according to claim 1, wherein the content of said copolymer (b) is in the range of from 1 to 20% by weight; the content of the amine-based antioxidant (c) is in the range of 0.05 to 5% by weight; and the thiadiazole compound (d) is in the range of 0.01 to 3% by weight.

15. The lubricating oil according to claim 1, which further comprises an alkenylsuccinic acid imide.

* * * * *